United States Patent [19]

Burwasser

[11] 4,287,286

[45] Sep. 1, 1981

[54] TONER REPELLANT COATING FOR DIELECTRIC FILM

[75] Inventor: Herman Burwasser, Boonton, N.J.

[73] Assignee: GAF Corporation, New York, N.Y.

[21] Appl. No.: 42,433

[22] Filed: May 25, 1979

[51] Int. Cl.[3] ..... G03G 21/00

[52] U.S. Cl. ..... 430/127; 430/63; 430/528

[58] Field of Search ..... 427/121; 430/62, 63, 430/127, 527–537

[56] References Cited

U.S. PATENT DOCUMENTS

| | | | |
|---|---|---|---|
| 3,549,360 | 12/1970 | O'Neill et al. | 96/1.4 |
| 3,861,954 | 1/1975 | Funderburk | 162/138 |
| 3,864,158 | 2/1975 | Timmerman et al. | 430/62 X |

*Primary Examiner*—Morris Kaplan

*Attorney, Agent, or Firm*—James Magee, Jr.

[57] ABSTRACT

Electroreprographic films comprising a support member which are capable of acquiring an electrostatic charge which on passing through a toner bath pick up unwanted toner outside the image area which is not fixed during development. The unwanted toner pick up is minimized by applying a layer of anti-static material to the otherwise uncoated back of the support.

4 Claims, No Drawings

TONER REPELLANT COATING FOR DIELECTRIC FILM

BACKGROUND OF THE INVENTION

It is well known that film supports for electrorepro-graphic imaging elements or films such as heat-set biaxially-oriented linear polyesters have a tendency to pick up electrostatic charges when being moved with respect to other objects such as the transport means and transport rollers and other parts of the hardware with which it is used. A film support so charged, when exposed to toner, particularly liquid toner, the liquid of which is insulating, pick up a random background or fog of toner which reduces the clarity and elegance of the copy. Toner picked up in this manner is adhered only lightly. When handled, or brushed against by clothing an unpleasant smudge results. The greater the static charge the greater amount of the weakly adherent toner is present which becomes a threat to ones clothing and in addition diminishes usefulness of the imaged film. In the case of a transparent electrostatographic recording element unwanted toner pick up often provides so much background that the contrast between the imaged and unimaged areas is sufficient to make the copy virtually useless.

SUMMARY OF THE INVENTION

The tendency of the non-conductive film support of an electrostatographic recording element to pick up toner can be reduced or substantially eliminated by applying to the uncoated side of the support antistatic compound or composition in the form of a layer or coating of sufficient conductivity to effectively prevent the accumulation of unwanted static charges.

DESCRIPTION OF THE PREFERRED EMBODIMENTS

Any insulating film support useful in making dielectric films will have the tendancy in varying degrees to pick up electrostatic charges during handling which results in the random accumulation of undesirable toner background. The problem is reduced or eliminated by means of providing an anti-static layer to the film support's otherwise uncoated surface.

Electrostatic imaging elements generally comprise a dielectric film support layer, a conductive layer, and a second dielectric layer coated on top of this conductive layer. The tendency of such element to pick up and retain unwanted background toner can be effectively reduced or substantially eliminated by providing on the uncoated side of the film support an antistatic layer of a conductive composition. Illustrative antistatic compositions include inorganic salts, resinous polymers of quaternary ammonium salts, homopolymers and copolymers of vinyl organic quaternary ammonium compounds and esters thereof, and the like.

These antistatic compositions are provided in amounts which are sufficient to dissapate static charges accumulated on the element as a result of handling and friction, i.e., an antistaticly effective amount. This conductive layer on the back of the film element will prevent adherence of toner at the site of the unwanted charges. Such toner would otherwise be at least partially fixed along with the image-proper and would cause background darkening.

The preferred film supports which have been found particularly suited to the present invention are heat-set, biaxially-oriented linear polyesters such as terephthalic acid ethylene glycol esters sold under the trademarks "Mylar","Melinex" or "Celanar". The films used as supports generally are from about 75 to 175 micrometers thick. They are strong, durable, and nonconductive. They are coated with a conductive layer which in turn is coated with a dielectric layer. Typical dielectric film configurations which are improved by the present invention are described in my patent applications Ser. No. 669,675 filed Mar. 29, 1976, now abandoned, and Ser. No. 902,913 filed May 5, 1978, now abandoned, which are incorporated herein by reference.

The conductive layer may be any of those conductive compounds or polymers well known to the art of electrostatic imaging. The use of carbon black or the usual inorganic salt compounds is possible in some instances, but the preferred conductive materials are conductive polymers such as sulfonated polystyrene, quaternized polymers of vinyl pyridine with aliphatic esters, polymers of polyacrylic acid salts and the like. Other suitable conductive coated supports are those commercially available from the Sierracin Corporation, under the tradenames Sierracin A and Sierracin B which are coated with a conductive layer of indium oxide doped with tin.

The conductive layers provided using the materials and polymers described above have resistivity values less than $10^{10}$ ohms/square at 50% relative humidity and preferably less than $10^{8}$ ohms/square.

It will be understood that the coating applied to the support adheres well to it. It retains a uniform independent integrity being continuous and of generally uniform thickness.

The following examples are given by way of illustration and not by way of limitation.

Examples I, II and III of suitable conductive compositions are coated on a terephthalic acid polyester of ethylene glycol, "Celanar" made by the Celanese Corporation. The film support was about 76 micrometers thick.

EXAMPLES

| I | II | III |
|---|---|---|
| Sulfonated Polystyrene 50g | Polyvinyl benzyl trimethyl ammonium chloride 50g | Poly 2-acrylamide N-methylol trimethyl ammonium chloride 50 g |
| Water 50 ml | Methanol 50 ml | Water 50 ml |
| Duponol G 3 drops | — | — |

The compositions were applied to their respective polyester supports using a #10 wire wound bar. Any suitable coating technique is usable as will be apparent to those skilled in the art.

A composition which was suitable as a dielectric layer was prepared as follows: Toluene 67 g was placed in a beaker which contained a stirrer rod and placed on a magnetic stirrer. The solvent solution was stirred while 33.0 g of styrenated acrylic resin (DeSoto-315, a product of the DeSoto Company of Des Plaines, Illinois) was added in increments. The composition was stirred for twenty minutes. The composition then had a viscosity of about 50 cps.

Five coatings were made using the dielectric composition. The three conductively coated films of Examples I, II and III, with IV and V which are film supports with a conductive layer of indium oxide doped with tin. The five supports were coated over the conductive layer with the dielectric resin composition using a #10 wire wound bar. The coatings were dried in an oven at 95° C. for about 35 minutes. The electrostatically imageable films were kept at ambient temperature and 50% relative humidity for about a half hour.

Several thicknesses of dielectric layers were prepared. Satisfactory results were obtained with layers ranging from 1.4 to 14.2 micrometers. The preferred thickness was from 1.4 to 10 micrometers while maximum density was obtained at a thickness of about 4–5 micrometers.

Other resins which may be used in the dielectric insulating coating include polyolefins, alkyd resins, polyester resins, polyvinyl resins, cellulose acetates, epoxide resins, copolymers of the above, shellacs and the like.

The dielectric films of Examples I, II and III with IV and V were separated into a series which were provided with a suitable anti-static layer on the uncoated side of the support and a second set which was left uncoated.

The anti-static coating is applied only to the uncoated side of the otherwise complete dielectric imaging element. An anti-static coating over the dielectric layer would impair or completely destroy the imaging capability of the dielectric imaging element.

The anti-static composition may be applied in any of the well known, conventional ways. An aqueous solution of 1.75 g of the sodium salt of sulfonated polystyrene is dissolved in 100 ml of water. This is applied to the uncoated surface of a dielectric imaging element using a #10 wire wound bar.

The ten samples prepared as described above were passed through conventional hardware, a Minolta 101 copier but not imaged. The pairs of dielectric imaging elements, coated with anti-static composition and uncoated were compared.

Duplicate sets of pairs prepared as set forth above were passed through a copier without imaging but through a liquid toner bath. The individual sheets measured 8½×11 inches. Squares of clean white cotton cloth measuring 6×6 inches were then used to wipe the side opposite the dielectric coated side of the imaging element. The cloth was rated on a sliding scale of 1 to 5 on the amount of toner wiped off. A rating of 1 indicating no apparent color on the cloth and a rating of 5 indicating extreme soiling. The results of this test are shown in Table I.

TABLE I

| Example | I | II | III | IV | V |
|---|---|---|---|---|---|
| Uncoated | 5 | 4+ | 5 | 5 | 4+ |
| Antistat Coated | 1 | 1 | 1+ | 1+ | 1 |

It can be seen from the comparisons between dielectric imaging elements in which the supporting film is left uncoated on one side and those which are provided with an anti-static layer that toner pick up is reduced or eliminated. Consequently the risk of smudging clothing or other materials which might come into contact with film which has been in contact with toner is reduced or eliminated.

The examples set forth above are given by way of exemplification and not by way of limitation. Workers skilled in the art of electrostatographic copying will be aware of several variations suggested by the teaching of the present application and which are within the spirit of the appended claims.

What we claim is:

1. A method for substantially preventing unwanted toner pick up on an electroreprographic imaging element having a film support layer, a conductive layer on said support, and a dielectric layer on said conductive layer, said method comprising application to the uncoated side of said film support an antistatic coating capable of substantially eliminating static electrical charges on the antistatically coated side of the film, said antistatic coating comprising a material selected from the group consisting of inorganic salts, resinous polymers of quaternary ammonium salts, homopolymers and copolymers of vinyl organic quaternary ammonium compounds and esters thereof.

2. The method of claim 1 wherein said antistatic layer is from about 1.4 to about 14.2 micrometers thick.

3. The method of claim 2 wherein the antistatic layer is from about 4 to about 5 micrometers thick.

4. The method of claim 2 wherein the antistatic composition is a sodium salt of sulfonated polystyrene.

* * * * *